United States Patent [19]

Byrns

[11] 4,416,583

[45] Nov. 22, 1983

[54] CENTRIFUGAL VAPOR COMPRESSOR

[75] Inventor: Edson H. Byrns, Syracuse, N.Y.

[73] Assignee: Carrier Corporation, Syracuse, N.Y.

[21] Appl. No.: 394,748

[22] Filed: Jul. 2, 1982

Related U.S. Application Data

[63] Continuation of Ser. No. 137,173, Apr. 4, 1980, abandoned.

[51] Int. Cl.[3] ..... F04D 27/00

[52] U.S. Cl. ..... 415/148; 415/158; 415/211

[58] Field of Search ..... 415/148, 157, 159, 151, 415/158, DIG. 3

[56] References Cited

U.S. PATENT DOCUMENTS 3,289,919 12/1966 Wood ..... 415/158 X
3,619,078 11/1971 Mount ..... 415/150
4,257,733 3/1981 Bandukwalla et al. ..... 415/158 X

FOREIGN PATENT DOCUMENTS 270707 10/1927 United Kingdom ..... 415/DIG. 3
336840 10/1930 United Kingdom ..... 415/DIG. 3

*Primary Examiner*—Stephen Marcus
*Assistant Examiner*—Joseph M. Pitko
*Attorney, Agent, or Firm*—David L. Adour

[57] ABSTRACT

A centrifugal vapor compressor and a method of assembling the same. The compressor comprises a housing defining an inlet passage and a diffuser passage, and an impeller blade rotatably mounted in the housing between the inlet and diffuser thereof. The compressor further comprises an annular recess defined by the housing and in communication with the diffuser passage, and an annular diffuser valve supported by the housing for axial movement within the annular recess and the diffuser passage between minimum and maximum throttling positions. A stop member is located adjacent to the housing and includes an end section axially located forward of the annular recess to limit forward axial movement of the diffuser valve. A fastening member is radially located external of the annular recess and disengagably secures the stop member to the housing.

2 Claims, 3 Drawing Figures

CENTRIFUGAL VAPOR COMPRESSOR

This application is a continuation of application Ser. No. 137,173, filed Apr. 4, 1980, now abandoned.

BACKGROUND OF THE INVENTION

This invention generally relates to centrifugal vapor compressors, and more particularly to diffuser valve assemblies therefor.

One of the major difficulties arising in the use of centrifugal vapor compressors for applications where the compressor load varies over a wide range is flow stabilization through the compressor. The compressor inlet, impeller, and diffuser passages must be sized to provide for the maximum desired volumetric flow rate. When there is a low volumetric flow rate through such a compressor, the flow may become unstable. That is, as the volumetric flow rate is decreased from a stable range, a range of slightly unstable flow is entered. In this range, there appears to be a partial reversal of flow in the diffuser passage, creating noises and lowering compressor efficiency. Below this range, the compressor enters what is known as surge, wherein there are periodic complete flow reversals in the diffuser passage, destroying the efficiency of the machine and endangering the integrity of the machine elements. Since a wide range of volumetric flow rates is desirable in many compressor applications, numerous modifications have been employed to improve flow stability at low volumetric flow rates. One widely known modification is to vary diffuser passage configuration in response to changes in the load on the compressor. Frequently, this is done by means of an annular diffuser valve which laterally moves across the diffuser passage to throttle vapor flow therethrough. More specifically, the compressor housing is provided with an annular recess in communication with the diffuser passage, and the diffuser valve is supported by the housing for movement within the annular recess and the diffuser passage. Means are provided to move the diffuser valve across the diffuser passage, thus throttling vapor flow therethrough. Often, a stop is provided to limit lateral movement of the diffuser valve at a maximum throttling position and maintain a minimum flow space through the diffuser passage.

The preferred maximum throttling position of the diffuser valve may vary from one machine to another, depending upon the specific application of the machine. Similarly, if the particular application of a compressor is changed, then the preferred maximum throttling position of a diffuser valve thereof may also change. With many types of compressors, providing otherwise identical compressors with diffuser valves having different maximum throttling positions, or varying the maximum throttling position of a particular diffuser valve has heretofore involved notable difficulties. For example, with many compessors, employing prior art valve stops which can be adjusted to change the maximum throttling position of the diffuser valve may interfere with the design or operation of other parts of the diffuser asembly such as the diffuser valve itself or the means used to move the valve across the diffuser passage. As a result, such compressors generally do not employ adjustable stops, and changing or adjusting the maximum throttling position of these compressors may require replacing a major, expensive part thereof, for example an entire wall or diaphragm of the compressor.

SUMMARY OF THE INVENTION

In view of the above, an object of the present invention is to improve centrifugal vapor compressors, particularly diffuser valve assemblies therefor.

Another object of this invention is to facilitate changing the maximum throttling position of a diffuser valve of a centrifugal vapor compressor.

A further object of the present invention is to disengagably secure a diffuser valve stop member to a compressor housing at a location radially beyond the impeller of the compressor.

These and other objectives are attained with a centrifugal vapor compressor comprising a housing defining an inlet passage and a diffuser passage, and an impeller blade rotatably mounted in the housing between the inlet and diffuser thereof. The compressor further comprises an annular recess defined by the housing and in communication with the diffuser passage, and an annular diffuser valve supported by the housing for axial movement within the annular recess and the diffuser passage between minimum and maximum throttling positions. A stop member is located adjacent to the housing and includes an end section axially located forward of the annular recess to limit forward axial movement of the diffuser valve, and fastening means is radially located external of the annular recess and disengagably secures the stop member to the housing.

A BRIEF DESCRIPTION OF THE DRAWINGS

A DETAILED DESCRIPTION OF THE PREFERRED EMBODIMENT

Figure 1:
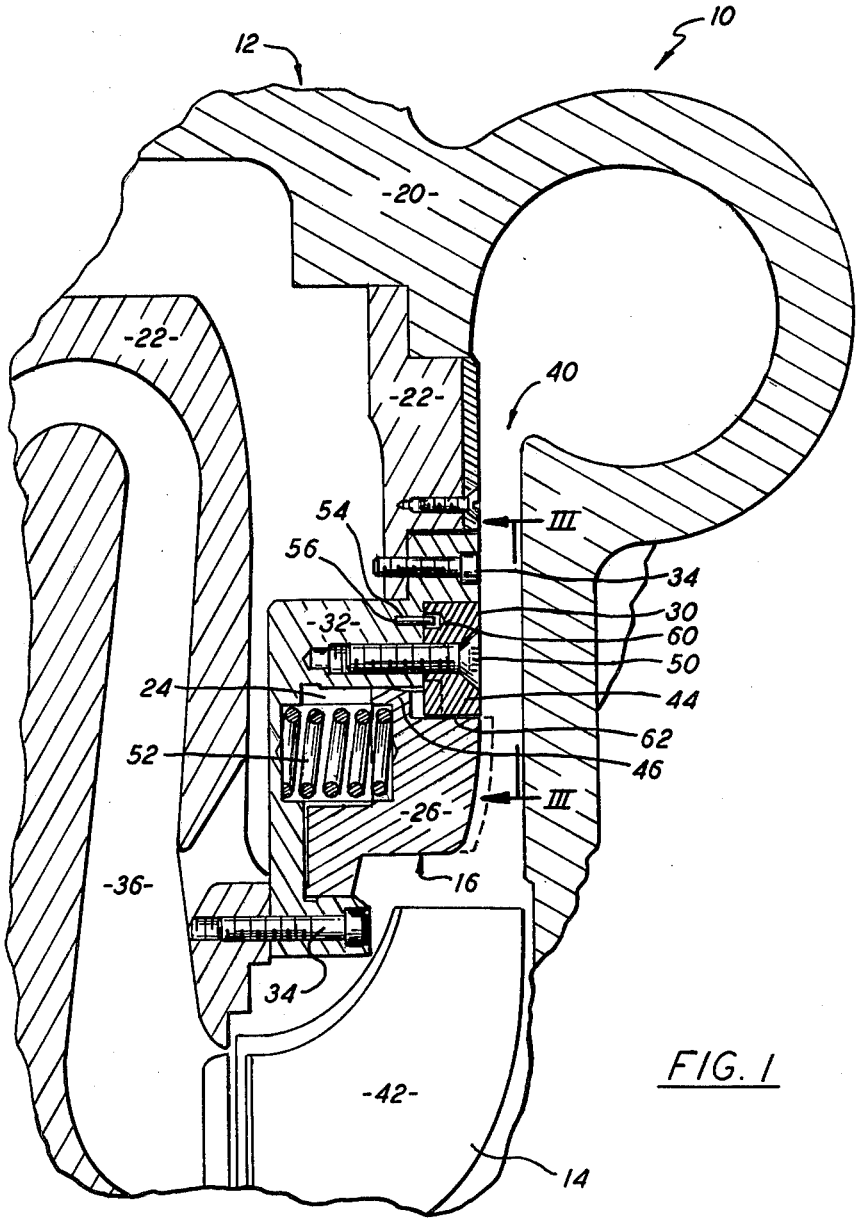
FIG. 1 is a side view, partly in cross section, of a portion of a centrifugal vapor compressor illustrating an embodiment of the present invention.

Referring generally to FIG. 1, there is shown portions of two stage vapor compressor 10 of the well known centrifugal type comprising housing 12, impeller 14, and diffuser valve assembly 16. Housing 12 includes outside, casing section 20 and inside, diaphragm section 22; and diffuser valve assembly 16 includes annular recess 24, diffuser valve 26, and stop member 30. As illustrated in FIG. 1, diaphragm 22 includes a separable diffuser valve support frame 32, discussed in greater detail below, secured to the remaining parts of the diaphragm by screws 34. As will be appreciated, diaphragm 22 could include a diffuser valve support frame integrally formed with the remaining parts of the diaphragm.

Casing and diaphragm sections 20 and 22 of housing 12 are joined together in any conventional manner and cooperate to define, inter alia, second stage inlet passage 36 and second stage diffuser passage 40. Impeller 14 is rotatably supported by housing 12 via an axially extending shaft and bearings (not shown), and the impeller is connected to a suitable driver (also not shown) which imparts rotary motion thereto. Impeller 14 includes second stage blade 42 located within housing 12 between second stage inlet and diffuser passages 36 and 40.

In operation, a vapor to be compressed is induced to flow in an axial direction into a first stage blade (not shown) of impeller 14. Rotation of the first stage blade compresses the vapor and directs the vapor radially outward into a first stage diffuser passage (not shown). The first stage diffuser passage conducts the vapor into second stage inlet 36 which directs the vapor into second stage blade 42. Rotation of second stage blade 42 further compresses the vapor and directs the vapor radially outward into second stage diffuser passage 40 from where the vapor may pass through a succeeding stage of compressor 10 or be discharged therefrom.

Figure 2:
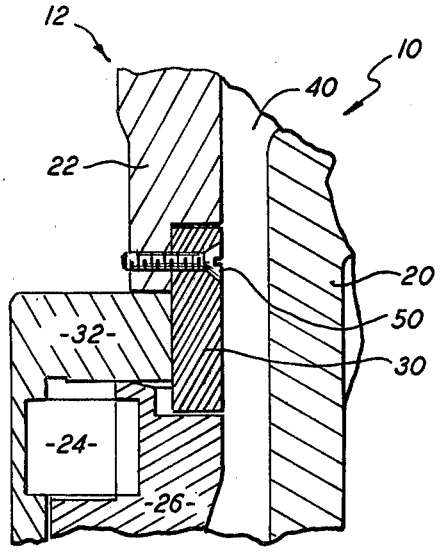
FIG. 2 is a partial side view of the compressor shown in FIG. 1 illustrating a second embodiment of the present invention.

Diffuser valve assembly 16 is provided for varying the configuration of diffuser passage 40, thus throttling vapor flow therethrough. More specifically, frame 32 of assembly 16 annularly extends around impeller 14 and defines annular recess 24 which extends from and is in communication with diffuser passage 40. Also, frame 32 supports diffuser valve 26 for axial or lateral movement within recess 24 and diffuser passage 40 between minimum and maximum throttling positions. In the preferred minimum throttling position, shown in full line in FIG. 1, diffuser valve 26 does not restrict the flow of vapor through diffuser passage 40. As diffuser valve 26 moves across diffuser passage 40 toward the maximum throttling position, shown in part in broken lines in FIG. 1, the diffuser valve throttles vapor flow through the diffuser passage. This throttling may be effectively employed, as is well known in the art, to maintain stable vapor flow through diffuser passage 40 as the vapor flow rate therethrough decreases. Stop member 30 is mounted on housing 12 for engagement with an axially extending, radially projecting face 62 of diffuser valve 26 to limit tangential movement thereof and for engagement with a radially extending surface 64 of the diffuser valve facing diffuser passage 40 to limit axial movement of the diffuser valve at the maximum throttling position. In particular, with reference to FIG. 3, diffuser valve 26 defines outside annular surface 66, face 62 radially extends inward from surface 66, preferably defining arcuate recess 68, and stop member 30 extends into this recess. In this manner, abutting contact between stop member 30 and face 62 prevents tangential movement of diffuser valve 26. This, among other things, maintains alignment of springs 52. That is, as diffuser valve 26 moves forward, from left to right as viewed in FIG. 1, and reaches the maximum throttling position, flange 46 of the diffuser valve abuttingly contacts stop member 30 and this abutting contact prevents further forward movement of the diffuser valve. Also, stop member 30 is disengagably secured to housing 12 by fastening means, for example screw 50, located external of recess 24. With the preferred arrangement illustrated in FIG. 1, screw 50 extends through stop member 30 and into support frame 32 to disengagably secure the stop member thereto. Alternately, screw 50 may extend through stop member 30 and into other parts of housing 12, for example, as shown in FIG. 2, the part of diaphragm 22 adjacent support frame 32, to disengagably secure the stop member to the housing. With either embodiment, preferably fastening means 50 is radially located beyond annular recess 24, and stop member 30 radially extends inward from the fastening means to a location axially forward of the annular recess.

Because stop member 30 is disengagably secured to housing 12 via screw 50, the stop member can be easily removed from compressor 10 and replaced with a second stop member allowing greater or less axial movement of diffuser valve 26, thus changing the maximum throttling position thereof. For example, stop member 30 can be replaced by another stop member having a stepped inward end section 44, as shown in broken lines in FIG. 1. More specifically, to replace stop member 30, diaphragm section 22 is removed from compressor 10, screw 50 is removed, and then stop member 30 is removed and replaced with a different stop member. Screw 50 is then reinserted, and diaphragm section 22 is reconnected to compressor 10. Thus, stop member 30 can be replaced by a relatively quick and simple procedure not requiring, for example, removal or disassembly of diffuser valve 26 from diaphragm section 22.

Also, with many compressors of the general type described above, inside sections of casing 20 defining diffuser passage 40 are removable from the rest of the casing, and hand holes are provided in the exterior of the casing to give a worker access to the inside, removable sections thereof. When the preferred embodiment of the present invention is employed with such compressors, because stop member 30 is disengagably secured to housing 12 radially outside impeller blade 42, it may be possible to remove and replace the stop member via the same hand holes which provide manual access to the inside, removable sections of casing 20. Hence, with such an arrangement, stop member 30 may be replaced without removing diaphragm section 22.

Furthermore, as may be understood from a review of the above discussion, otherwise identical compressors 10 may be assembled with different maximum throttling positions by simply providing the compressors with different stop members 30. That is, once the desired maximum throttling position of a particular compressor is known, the compressor is assembled by selecting a stop member 30 having end section 44 with a predetermined depth which, when properly secured in place, will stop diffuser valve 26 at the desired maximum throttling position. Then the selected stop member 30 is secured to housing 12 with end section 44 axially located forward of recess 24. Hence, the present invention may be employed to manufacture a plurality of compressors which are identical except for different maximum throttling positions without requiring, for example, different diffuser frames, diffuser valves, or any complex mechanical or pneumatic linkage systems.

It should be noted that, while only one stop member 30 is illustrated in FIG. 1, preferably diffuser valve assembly 6 includes a plurality of stop members, for example three, equally spaced along frame 32. Moreover, while the illustrated compressor 10 employs diffuser valve assembly 16 to vary the configuration of second stage diffuser passage 40, it will be appreciated that the diffuser valve assembly may be associated with any one or more diffuser passages of the compressor.

Additionally, as will be apparent to those skilled in the art, various means or arrangements may be employed to move diffuser valve 26 between the minimum and maximum throttling positions. One relatively simple arrangement, as an example, utilizes a plurality of springs 52 to urge diffuser valve 26 toward the maximum throttling position. At the same time, the section of recess 24 rearward of diffuser valve 26 may be selectively connected to one or more pressure sources to reduce the pressure rearward of the diffuser valve and thus develop a pressure difference thereacross urging the diffuser valve toward the minimum throttling position. By varying the pressure difference across diffuser valve 26, the net force thereon may be varied to selectively move the diffuser valve between the minimum and maximum throttling positions.

Figure 3:
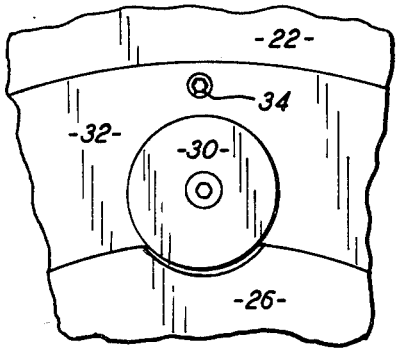
FIG. 3 is a partial front view taken along line III—III of FIG. 1, showing the diffuser stop member and parts of the diffuser valve and valve support frame of the compressor shown in FIG. 1.

Referring to FIG. 3, when viewed from the front, preferably stop member 30 has a circular shape with screw 50 extending through the center thereof. With this arrangement, stop member 30 may tend to rotate about screw 50. Such rotation is undesirable when stop member 30 includes a stepped inward end section; and, returning to FIG. 1, pin 54 is provided to maintain alignment of the stop member. More particularly, frame 32 of diffuser valve assembly 16 defines axially extending pinhole 56 having a diameter slightly larger than pin 54 and an axial length shorter than the pin. Stop member 30 defines axially extending pinhole 60 which also has a diameter slightly larger than pin 54 and an axial length shorter than the pin. Pinholes 56 and 60 are located so that they are axially aligned when stop member 30 is secured in place. A first end of pin 54 is located within pinhole 56, and the pin extends therefrom into pinhole 60, preventing rotation of stop member 30 about screw 50.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

I claim:

1. A centrifugal vapor compressor comprising:

a housing defining an inlet passage, a diffuser passage, and a diffuser valve recess extending from the diffuser passage;

an impeller rotatably mounted in said housing on an axially extending shaft and including a radially extending impeller blade;

an annular diffuser valve extending around the impeller blade and supported by the housing for axial movement within the diffuser valve recess and the diffuser passage between minimum and maximum throttling positions, said annular diffuser valve having an outside annular face facing the diffuser passage, at least one axially extending, radially projecting face extending radially outward from said outside annular face, and a flange radially extending from each of said axially extending, radially projecting faces, each of said flanges having a radially extending surface facing the diffuser passage;

stop members mounted on the housing in the diffuser passage portion of the housing, each of said stop members having a surface facing the diffuser passage which is coplanar with the walls of the diffuser passage and each of said stop members positioned for engagement with one of the axially extending, radially projecting faces of the diffuser valve to limit movement of the diffuser valve circumferentially about its axis and positioned for engagement with the radially extending surface of each of the flanges of the diffuser valve to limit axial movement of the diffuser valve at the maximum throttling position; and fastening means for disengagably securing each of the stop members to the housing.

2. The centrifugal vapor compressor as defined by claim 1 wherein said axially extending, radially projecting face of said diffuser valve has an arcuate shape.

* * * * *